US007127770B2

(12) United States Patent
Clegg et al.

(10) Patent No.: US 7,127,770 B2
(45) Date of Patent: Oct. 31, 2006

(54) LED BRUSH

(76) Inventors: Tim Clegg, 19220 S. Normandie Ave., Torrance, CA (US) 90502-1011; Michael Bistocchi, 4180 Ironwood Ave., Seal Beach, CA (US) 90740; Fran Lantz, 13620 Bass Trail, Grass Valley, CA (US) 95945

( * ) Notice: Subject to any disclaimer, the term of this patent is extended or adjusted under 35 U.S.C. 154(b) by 271 days.

(21) Appl. No.: 10/850,746

(22) Filed: May 22, 2004

(65) Prior Publication Data

US 2005/0257337 A1 Nov. 24, 2005

(51) Int. Cl.
*A46B 15/00* (2006.01)

(52) U.S. Cl. ..... 15/105; 15/106; 15/160; 362/9

(58) Field of Classification Search ..... None
See application file for complete search history.

(56) References Cited

U.S. PATENT DOCUMENTS 6,029,304 A * 2/2000 Hulke et al. ..... 15/105
6,106,294 A * 8/2000 Daniel ..... 433/216

* cited by examiner

*Primary Examiner*—David Redding
(74) *Attorney, Agent, or Firm*—Clement Cheng

(57) ABSTRACT

A lighted brush has a brush head mounted on a housing. Batteries stored within the housing power a seven color LED module made of three light emitting diodes (LEDs). A transparent handle illuminated by the seven color LED module has a module controller. The transparent handle mounted on the housing at a housing end is an acrylic rod directing light from the end of the rod and from the sides of the rod.

17 Claims, 3 Drawing Sheets

LED BRUSH

DISCUSSION OF RELATED ART

A large number of makeup brush improvements have allowed users improved applications of make up. Variation in brush design and brush specialization allows improved application, but increases cost.

A set of makeup brushes commonly comprises a variety of brushes including the blush brush, finishing fan, eye shadow, eye comb, and mini brush. The concealer brush has a square head to tapered corners used for blending under the eye. The foundation brush has a widely tapered flat head usually used for applying liquid or cream foundations. The larger powder brush has a fuller larger rounded dome shape head for application and spreading powder that can be used for pressed powder and lose beads. It can also be used to brush off excess powder. The blush brush also has a large head with slight tapering but the head is flatter and designed for a more even distribution commonly used on the cheeks and cheekbone. An eye shadow brush commonly has a square head and narrow width of less than a half-inch and has a slight tapering corner ending at a flat bristle head commonly soft for application of eye shadow to the eyelids. By using the edge, it can be used for defining eyelid crease. A small slanted brush has a narrow, slanted and flat head with soft but firm bristles used for fine lines around lash lines and for blending and softening colored edges. A lip brush appears to be a small narrow and flat tapered end brush that blends lip liner and lipstick. The lip brush commonly is retractable for portability. The eyebrow and eyelash brush is a soft bristle to see used for shipping the brows, and separating eyelashes and grooming mascara. The eyebrow and eyelash brush can be used in combination with hair spray or gel for applying the hairspray to eyebrows. Other kinds of cosmetic brushes are commonly named by their functions that include the concealer, the corrector, the contour, the blender, the smudger, the eyeliner, and the brow definer. These functional names are descriptive of the structural names previously listed. Many of these functional names are the same as the structural names previously listed.

Including artistic and skills advancement, a make up user can also improve makeup brush technology in an effort to improve results. U.S. Pat. No. 6,418,939 describes inclusion of powder with brush head allowing continuous application powder. Having a reservoir of powder allows continuously efficient powder application. In other inventions, electrostatic discharge compensation presents powder scatter. Adjustable length bristles also offer improved brush application of cosmetics powder as described in U.S. Pat. No. 5,027,838. Other types of inventions have improved the variable length capabilities of powder brushes.

CALL OUT LIST OF ELEMENTS

110 Translucent Acrylic Rod

120 Button

130 Main Housing

140 Brush fitting means

150 Brush (Head)

280 LED(s)

290 End

DESCRIPTION OF THE PREFERRED EMBODIMENT

Figure 1:
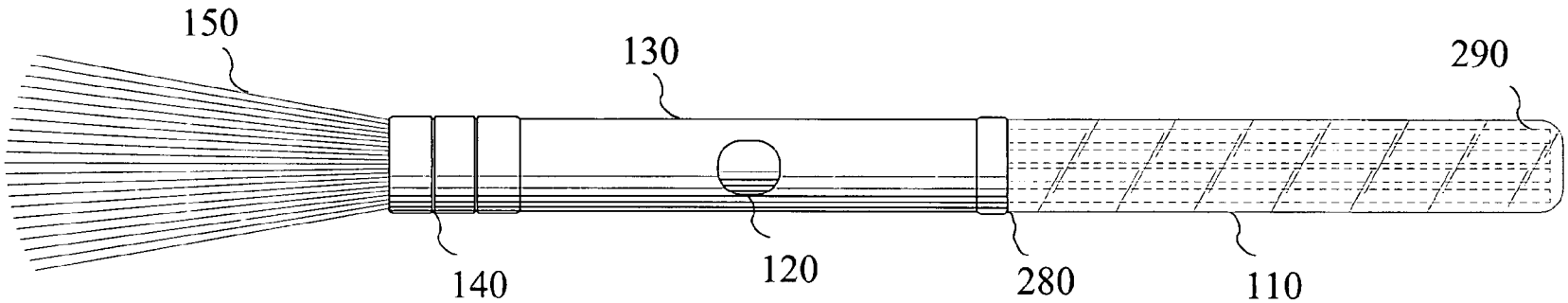
FIG. 1 is a top view of the present embodiment.
Figure 2:
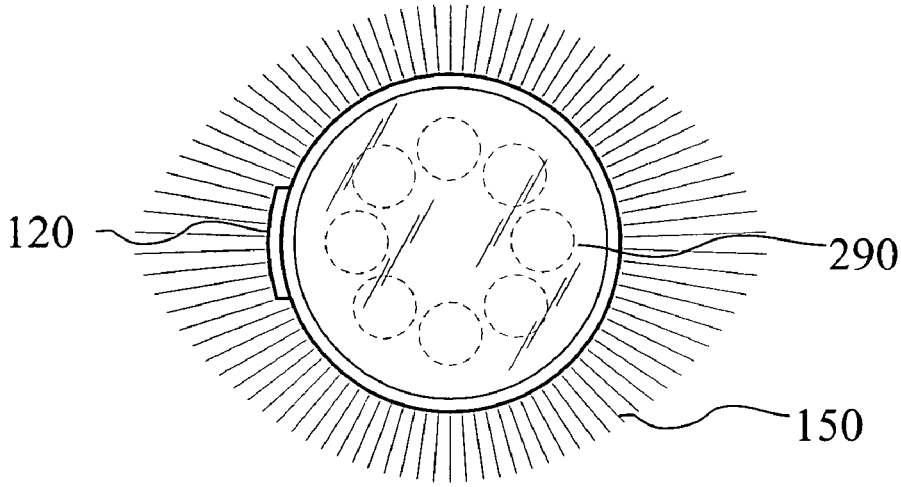
FIG. 2 is a front view of the present embodiment.
Figure 3:
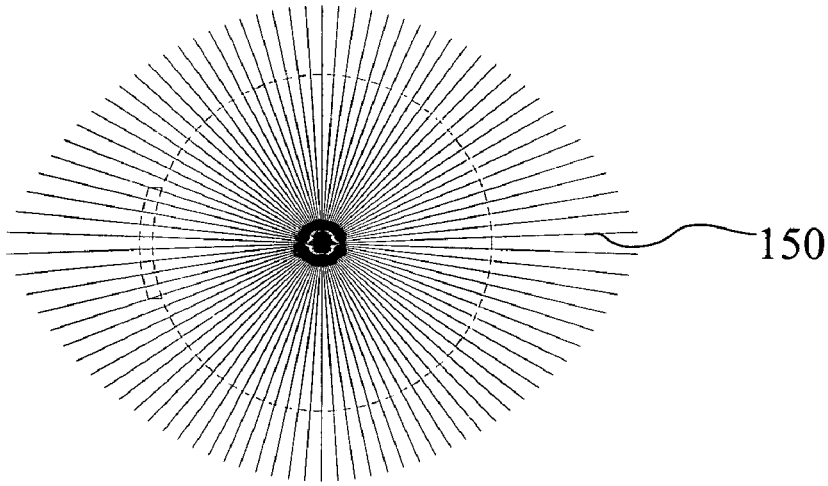
FIG. 3 is a rear view of the present embodiment.
Figure 4:
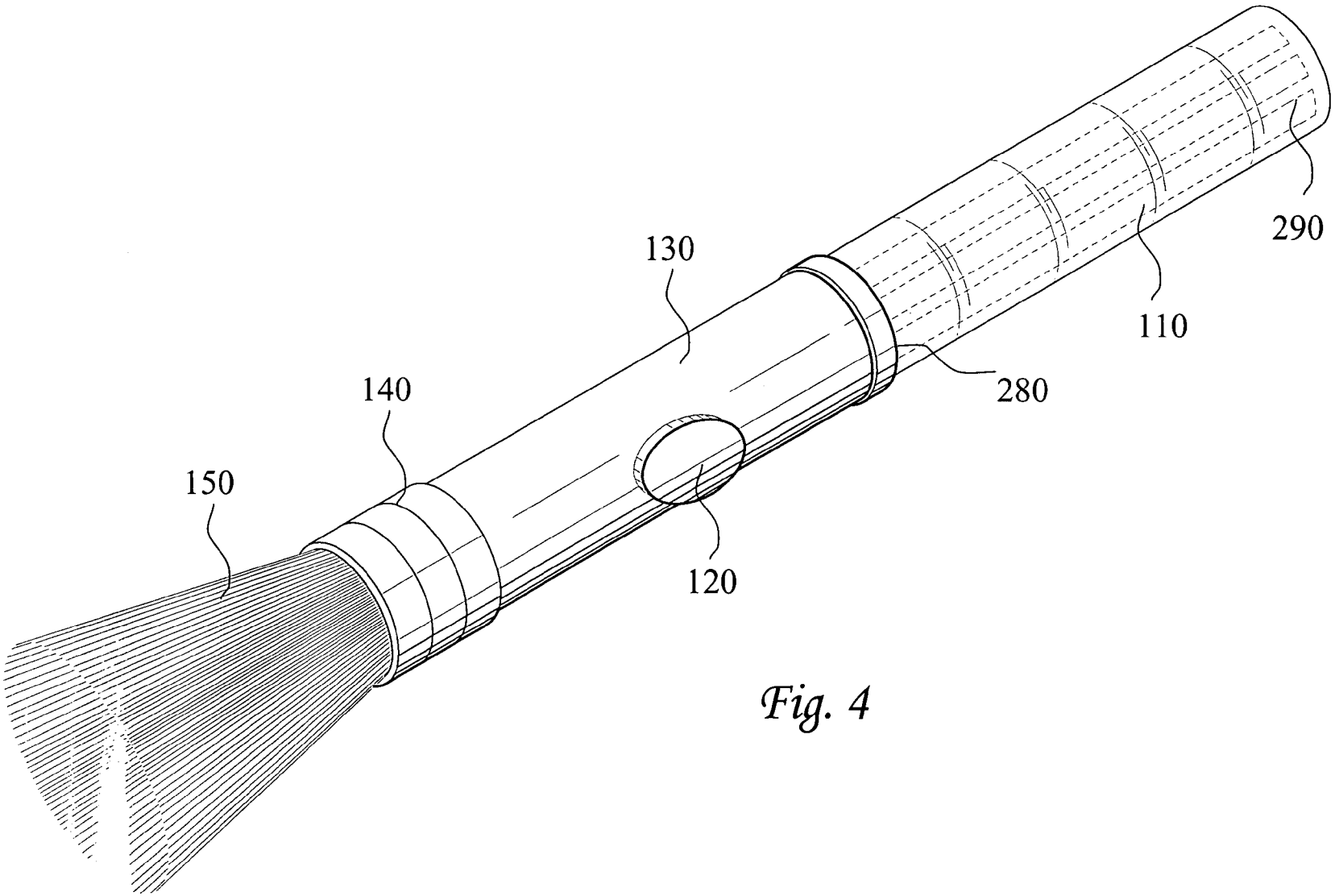
FIG. 4 is a perspective the view of the present embodiment.

The tip of the transparent or translucent acrylic rod 110 emanates a variety of colors allowing a user to use the colored light as a color reference and light tool when applying cosmetics.

The lighted brush includes a brush 150 mounted to a metal fitting housing 140. The brush fitting metal housing is removable. Upon removal, a user can access the batteries. The batteries are removable and replaceable. The batteries can be made of any variety of configurations including a single battery having 4.5V, or 3 button batteries held in series each having 1.5V. The present embodiment has a seven-color module having a module controller. The seven-color module is made of three light emitting diodes (LEDs) 280 to create up to seven different colors. The LED implementation can be formed by a single LED capable of emitting multiple colors of light or by multiple light emitting diodes mounted close together. LED dies can be formed in a wide variety of configurations. A version that emits only one color is also available. With the present embodiment, with each button press the LED's light and illuminate the acrylic rod on the opposite end of the brush. Pressing the button 120 mounted on the main housing 130 activates the LED and then turns the LED off. Although a seven color module is preferred, use of a three color module or single color module is also possible. The primary colors of the light including red, green, blue can also be substituted with other colors including yellow, white, magenta.

The brush has a blue light, a green light and a red light. The lights activate together, in combination and separately. Pressing the single button 120 activates a sequence of the light and pressing the single button deactivates the light. Pressing the single button again activates a next sequence of the light. Sequences include single light activation including activation of the red light alone, activation of the blue light alone, and activation of the green light alone. Sequences also include combination like activation including activation of the red light and green light, activation of the green light and blue light to make a bluish green light, activation of the red light and blue light forming a purple light and activation of all three lights forming a white light. Sequences can also include transient activation wherein the lights activate and deactivate according to a timed predetermined sequence. For example, transient activation can include the activation of the red light for a total of one second after a user presses the single light activation button, then activating the green light half a second later for a total of one second, then activating the blue light half a second later for a total of one second. The transient activation sequence can be cycled allowing the creation of red, then red and green, then green, then green and blue, then blue, then blue and red, then red alone.

The lights 280 are mounted on the main housing end of the transparent acrylic rod 110. The acrylic rod can be used as a handle. The transparent acrylic rod is preferably cylindrical having a plurality of extruded designs parallel to the central axis of the cylindrical acrylic rod. The extruded designs are formed from extruding non-transparent white plastic preferably translucent through a die extruding the cylindrical acrylic rod so that translucent white plastic forms and extruded design within the acrylic rod. The acrylic rod has a terminal end with beveled tip. One example of an extruded design is represented on a two-dimensional plane and is shown in the figure that shows the terminal tip of the acrylic rod. The extruded design is represented here as eight circular portions of translucent plastic. The translucent plastic is preferably white allowing and accepting a variety of colors. The design as seen by a casual user appears to be eight circular rods held within the transparent acrylic rod handle. A wide variety of designs can be extruded into the acrylic rod.

The design of the translucent portion allows variant dissipation of colored light. The design can be altered according to the light needs and purposes of the brush. A user may use the colored light as a reference and tool when applying cosmetics. The tip of the transparent or translucent acrylic rod emanates a variety of colors allowing a user to use the colored light as a reference and tool when applying cosmetics. For example, a user may compare the emanated light to the color of cosmetics applied. The user may also compare the apparent color of the cosmetics applied under a variety of spectra.

The lights are mounted in the main housing portion housing the battery, the electronic controller, and the light switch. The lights have an orientation directing light away from the housing portion through the transparent acrylic rod handle so that the terminal tip of the acrylic rod handle receives direct light while the translucent design portion of the acrylic rod handle offers indirect light.

The brush 150 can be any cosmetic brush including the blush brush, finishing fan, eye shadow, eye comb, mini brush, concealer brush, foundation brush, powder brush, eye shadow brush, small slanted brush, lip brush, eyebrow and eyelash brush. The present embodiment can include a brush head having a fan configuration, or any of the other variety of brushes commonly used for make up. Brushes are commonly made of the pony, sable or badger. The present embodiment can include a brush head having bristles made of a variety of materials.

The brush portion of the device secures to the main housing by a metal coupling fitter 140 binding the brush. The metal coupling can optionally be detachable allowing modular detachment of different brushes and allowing replacement of brush heads. The brush heads can include modular versions of the common brushes such as: eyelash brush, blush brush, eye shadow pressure, slanted brush, concealer brush, foundation brush, or powder brush. The brush head modular connector also forms the cap retaining the batteries within the housing. Removing the brush and allows a user to remove the batteries stored in series.

The invention claimed is:

1. A lighted brush comprising:

a brush head mounted on a housing;

batteries stored within the housing, the batteries powering a seven color LED module made of three light emitting diodes (LEDs);

a transparent handle illuminated by the seven color LED module having a module controller;

the transparent handle mounted on the housing at a housing end and formed as an transparent rod directs light from the end of the rod and from the sides of the rod.

2. The lighted brush of claim 1, wherein the transparent handle formed as an acrylic rod further comprises translucent extruded portions of plastic held within the acrylic rod.

3. The lighted brush of claim 1, wherein the module controller creates transient activation of a red light for a total of one second after a user presses a single light activation button, then activating a green light half a second later for a total of one second, then activating a blue light half a second later for a total of one second; the module controller creating transient activation sequence can be cycled allowing the creation of red, then red and green, then green, then green and blue, then blue, then blue and red, then red alone.

4. The lighted brush of claim 1, wherein the module controller creates light such that pressing a single button activates a sequence of the light and pressing the single button deactivates the light.

5. The lighted brush of claim 1, wherein the module controller creates single light activation including activation of the red light alone, activation of the blue light alone, and activation of the green light alone.

6. The lighted brush of claim 1, wherein the brush head is selected from the group of: blush brush, finishing fan, eye shadow, eye comb, mini brush, concealer brush, foundation brush, powder brush, eye shadow brush, small slanted brush, lip brush, eyebrow or eyelash brush.

7. The lighted brush of claim 1, wherein the brush head is mounted on a modular connector.

8. A lighted brush comprising: a brush head mounted on a housing: batteries stored within the housing, the batteries powering a LED module made of at least one light emitting diode (LED):

a transparent handle illuminated by the LED module having a module controller;

the transparent handle mounted on the housing at a housing end and formed as a transparent rod directing light from the end of the rod and from the sides of the rod, wherein the module controller creates light such that pressing a button activates a sequence of the light and pressing the button again deactivates the light.

9. A lighted brush comprising:

a brush head mounted on a housing;

batteries stored within the housing, the batteries powering a LED module made of at least one light emitting diode (LED);

a transparent handle illuminated by the LED module having a module controller;

the transparent handle mounted on the housing at a housing end and formed as a transparent rod directing light from the end of the rod and from the sides of the rod, wherein the module controller creates single light activation including activation of a red light alone.

10. A lighted brush comprising:

a brush head mounted on a housing;

batteries stored within the housing, the batteries powering a LED module made of at least one light emitting diode (LED);

a transparent handle illuminated by the LED module having a module controller;

the transparent handle mounted on the housing at a housing end and formed as a transparent rod directing light from the end of the rod and from the sides of the rod, wherein the module controller creates single light activation including activation of a blue light alone.

11. A lighted brush comprising:

a brush head mounted on a housing;

batteries stored within the housing the batteries powering a LED module made of at least one light emitting diode (LED):

a transparent handle illuminated by the LED module having a module controller;

the transparent handle mounted on the housing at a housing end and formed as a transparent rod directing light from the end of the rod and from the sides of the rod, wherein the module controller creates single light activation including activation of a green light alone.

12. The lighted brush of claim 8, wherein the brush head is selected from the group of: blush brush, finishing fan, eye shadow, eye comb, mini brush, concealer brush, foundation brush, powder brush, eye shadow brush, small slanted brush, lip brush, eyebrow or eyelash brush.

13. The lighted brush of claim 8, wherein the transparent handle formed as an acrylic rod further comprises translucent extruded portions of plastic held within the acrylic rod.

14. The lighted brush of claim 8, wherein the transparent handle formed as an acrylic rod further comprises translucent extruded portions of plastic held within the acrylic rod.

15. The lighted brush of claim 8, wherein the module controller creates transient activation of a first light for a total of one second after a user presses the single light activation button, then activating a second light half a second later for a total of one second, then activating a third light half a second later for a total of one second; the module controller creating transient activation sequence can be cycled allowing the creation of a light cycle.

16. The lighted brush of claim 15, wherein the transparent handle formed as an acrylic rod further comprises translucent extruded portions of plastic held within the acrylic rod.

17. The lighted brush of claim 8, wherein the module controller creates single light activation including activation of a blue light alone.

* * * * *